United States Patent [19]

Meyer,Jr.

[11] 4,449,472

[45] May 22, 1984

[54] DETACHABLE STORAGE TANK FOR HYDROFOILS

[75] Inventor: John R. Meyer,Jr., Deerwood, Md.

[73] Assignee: The United States of America as represented by the Secretary of the Navy, Washington, D.C.

[21] Appl. No.: 383,074

[22] Filed: May 28, 1982

[51] Int. Cl.[3] ..... B63B 1/24; B63B 1/28

[52] U.S. Cl. ..... 114/274; 114/18

[58] Field of Search ..... 114/274, 278, 280, 61, 114/321, 322, 330, 316, 317, 338, 284, 283, 18

[56] References Cited

U.S. PATENT DOCUMENTS

| | | | |
|---|---|---|---|
| 3,085,533 | 4/1963 | Goryl et al. | 114/74 T |
| 3,368,510 | 2/1968 | Humphrey | 114/317 |
| 3,429,287 | 2/1969 | Uram | 114/330 |
| 3,785,319 | 1/1974 | Danforth | 114/280 |
| 3,943,873 | 3/1976 | Hering et al. | 114/74 R |

FOREIGN PATENT DOCUMENTS

| | | | |
|---|---|---|---|
| 637302 | 3/1962 | Italy | 114/274 |

*Primary Examiner*—Sherman D. Basinger
*Assistant Examiner*—Edwin L. Swinehart
*Attorney, Agent, or Firm*—R. F. Beers; L. A. Marsh; R. F. Gnuse

[57] ABSTRACT

An easily detachable storage tank for use with existing hydrofoil ships is connected to the ship by two struts with minimal modifications to the ship. The shipboard connections are such that the ship is also usable without the storage tank. The tank may store fuel in a plurality of cells having a diaphragm separating the fuel from ballast seawater. Weapons may also be stored in the tank and fired directly from the tank.

6 Claims, 4 Drawing Figures

COMPRESSED AIR
FUEL TANK

DETACHABLE STORAGE TANK FOR HYDROFOILS

BACKGROUND OF THE INVENTION

1. Field of the Invention

This invention relates to a storage tank to be connected to a hydrofoil and more particularly to an underwater storage tank for fuel and/or weapons which is readily detachable from a hydrofoil ship.

2. Description of the Prior Art

The development of hydrofoil ships has advanced dramatically in the recent past. Such ships are no longer merely of scientific interest, but are becoming a regular part of both commercial and military operations. In particular, the U.S. Navy has produced hydrofoil fighting ships for defense purposes. Such ships have advantages over conventional surface ships in terms of speed, motions and manueverability.

By design, most hydrofoils are small in size and light in weight in order to achieve design speed and in order to limit the size of the foils. As a result, the amount of fuel and payload which may be carried is limited. If the amount of fuel carried is limited, the range of the ship is correspondingly limited. Similarly, if the weapons payload is limited, the destructive capability of the ship is limited. Hence, current hydrofoils are limited in range and payload capability due to limits of size and weight.

Various ships have been designed in recent years having submerged or semi-submerged portions. U.S. Pat. No. 3,429,287 describes a ship made of a submerged portion and an upper portion connected by a hydrofoil system. This system allows faster speeds than conventional ships due to the removal of surface wave resistance, but does not achieve the speed and manueverability of true hydrofoil vessels. While the submersible portion may be utilized for any form of storage, it must be loaded by conventional techniques.

U.S. Pat. No. 3,842,772 describes a semisubmerged ship having one or more hulls to house machinery or crew quarters. While this design lessens the effect of waves and insures greater stability, it requires that any loading in the storage areas be accomplished by conventional techniques. Similarly, U.S. Pat. No. 3,897,744 describes a high speed semisubmerged ship which requires conventional loading. Neither of these ships rise out of the water like a true hydrofoil.

SUMMARY OF THE INVENTION

The present invention is directed to providing a storage area for fuel and/or weapons which is readily detachable for easy loading from a conventional hydrofoil vessel. The storage tank is submerged and permits a greater range or greater firepower for the craft. The tank also provides buoyant lift to augment the lift from the foil system.

Accordingly, one object of this invention is to provide a new and improved detachable storage tank for a hydrofoil vessel.

Another object of this invention is to provide a submerged storage tank for a hydrofoil which does not adversly affect handling characteristics of the vessel.

A further object of this invention is to provide a storage tank which is readily attachable to an existing vessel and may be omitted completely if desired.

Another object of this invention is to provide an additional fuel supply for a vessel and accordingly increase its range.

A still further object of this invention is to provide a storage area for weapons and accordingly increase the firepower of a vessel.

Another object of the invention is to provide a storage tank which may be quickly loaded onto a ship.

Another object of the invention is to provide a submerged fuel tank which may be controlled as to buoyancy by partial filling with seawater or air.

BRIEF DESCRIPTION OF THE DRAWINGS

A more complete appreciation of the invention will become apparent from the following detailed description when considered in connection with the accompanying drawings wherein.

DESCRIPTION OF THE PREFERRED EMBODIMENT

Figure 1:
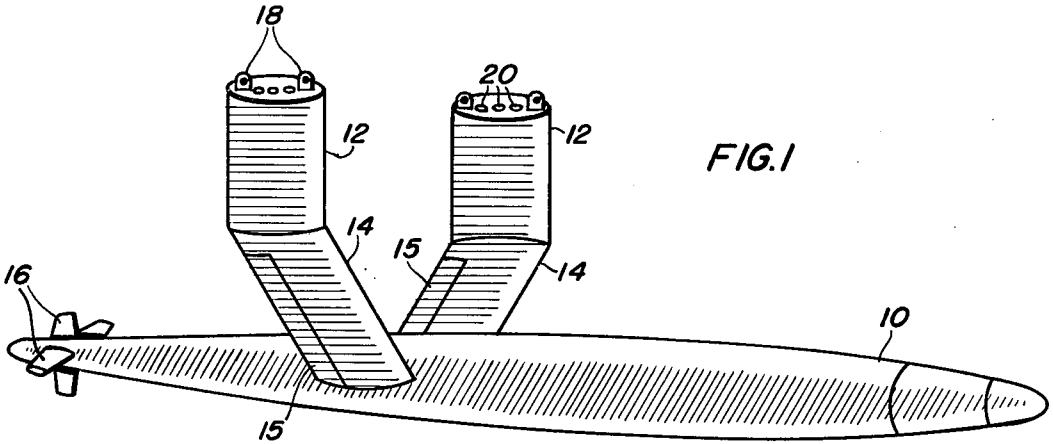
FIG. 1 is a perspective view of the subject invention.

Referring now to the drawings wherein like reference characters designate identical or corresponding parts throughout the several views and more particularly to FIG. 1 wherein the overall arrangement of the invention is shown as including a torpedo shaped hull 10 containing the storage tank. A pair of mounting struts 12 extend upwardly for connection to the outside of the hull of a hydrofoil. The struts 12 are connected to the hull 10 by a pair of surface piercing foils 14. The struts are connected to the hydrofoil hull by means of attachment fittings 18. These fittings are attached to matching fittings on the hull of the hydrofoil by the use of bolts or similar fasteners which are readily operable. The fasteners are positioned as close as possible to the deck of the ship so as to be more easily reached by personnel on board. The struts and foils contain a series of conduits for carrying electrical and hydraulic power to the storage tank and when fuel is stored in the tank, for carrying the fuel to the ship. Connections 20 for the conduits mate with appropriate conduits on board. A steering system 16 is present near the rear of the tank hull to add additional steering capability. Similarly, the trailing edge 15 of foils 14 are formed as control surfaces for additional roll control.

Figure 2:
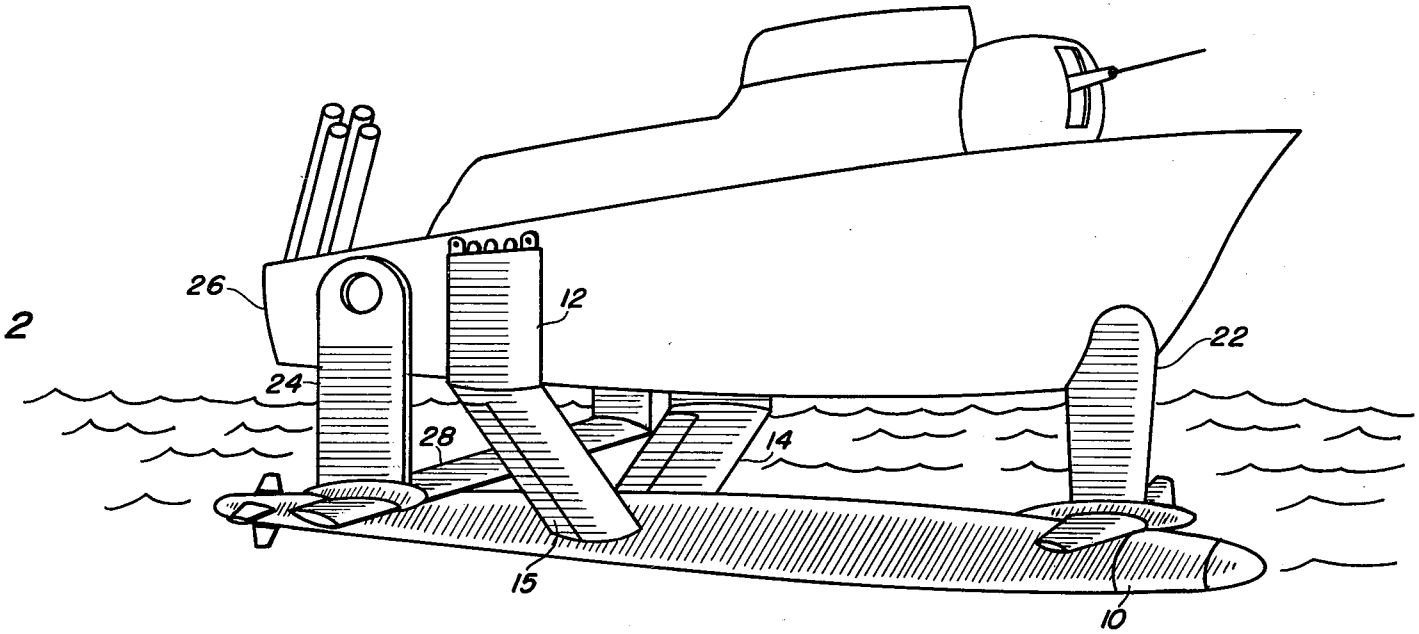
FIG. 2 is a perspective view of a hydrofoil with the subject invention installed.

FIG. 2 shows the storage tank installed on a hydrofoil ship. The struts 12 extend upwardly next to the hull of the ship and near the center thereof. The front end of the tank hull 10 is placed below the front foil and strut assembly 22, but is not attached thereto. The rear of the tank hull 10 extends below the rear foil 28 near the center thereof and between the two struts 24, but is not attached thereto. The only points connecting the tank hull to the ship hull are the attachment fittings and conduit connections at the top of the struts 12.

The general method of operation of this device and the reason for its use now becomes clear. The original hydrofoil is limited as to onboard space and weight. In order to increase its capability for carrying fuel, weapons or other payload, the submerged storage tank is added. The tank may be added to an existing ship without modification to the ship except for the attachment fittings, fuel lines and required control lines on the side of the hull. As a result, the tank may be left off completely if desired without adverse effect as to the capabilities of the ship. This allows the ship to operate in either of the two modes without extensive modification.

In addition, where it is necessary for the ship to return to port for refueling or reloading, the quick change capability of the storage tank allows the ship to quickly reload by removing the tank and replacing it with a full tank, thus reducing turn around time. Certainly such a manuever would take no more than a day and conceivably could take only a few hours. In addition, refueling and reloading of the tanks can be performed at convenient times and conditions with the full tanks stockpiled until needed. If one or more vessels return to port at inconvenient times, only a few men are necessary to disconnect and reconnect the tank, rather than a full reloading crew. Thus, work schedules are more easily arranged. The use of the detachable tank is comparable to the use of containerized shipping on freighters and many of the advantages of containers are also realized in ease of handling, speed of loading and quick turn around time for ships. The latter is particularly important for military ships on duty.

While the shape of the tank hull is designed to minimize drag and other effects on the ship's performance, there is nevertheless some effect. In particular, the turning ability is effected due to the presence of this large body acting against the water. In order to counteract these effects, a steering arrangement has been added at the rear of the tank. The steering is controlled hydraulically by way of the conduits in the struts. The added steering power overcomes the adverse effect of the presence of the storage tank and returns the steering capabilities of the ship to about 75% of its original level. Similarly, control surfaces are present on the trailing edge of the foils of the tank for additional roll control. While the controls have been described as hydraulic, it is clear that control may be accomplished by other means.

The weight of the tank may also be partly counteracted by a buoyancy arrangement where air is forced into the storage tank. While this aids in lowering the load on the ship foils, it is necessary to control the buoyancy so as not to make the craft unstable when hull-borne under high wind conditions.

Figures 3, 4:
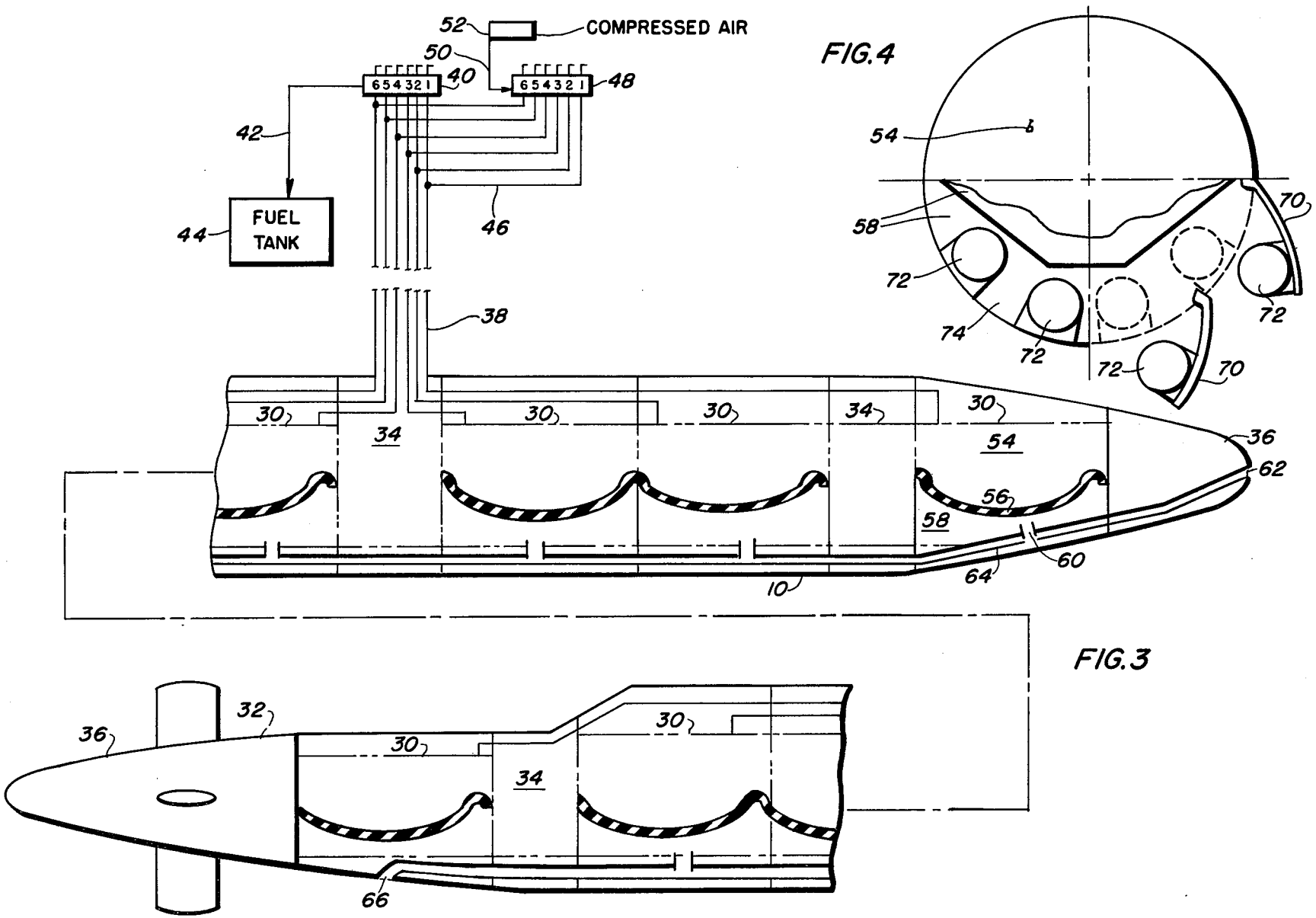
FIG. 3 is a diagrammatic view of one embodiment of the subject invention.
FIG. 4 is a diagrammatic view of a cross-section of a second embodiment of the subject invention.

FIG. 3 shows a particular use of the storage tank, specifically as a storage area for fuel. The tank 10 is divided for example, into six fuel cells 30, a compartment for steering gear 32, three access compartments 34 and a void compartment 36 at the front and rear of the tank. The fuel cells are each connected to a conduit 38 which carries the fuel from the cell to the ship through the struts. Each conduit 38 is connected to a common conduit 42 through selector valves 40. The valves select which conduit comes into communication with the common conduit 42. The common conduit carries fuel to the traditional fuel tank 44 on board the ship. A source of compressed air 52 is similarly connected to selector valves 50, each of which is connected to conduit 38.

Each fuel cell 30 is divided into two compartments by a diaphragm which extends completely across the cell. The two compartments formed are liquid tight. The upper compartment contains fuel, and when necessary, air for buoyancy. The lower compartment contains seawater ballast. The diaphragm is flexible so that the compartment sizes may vary from near zero volume to near the full volume of the cell. Seawater may enter the lower compartment by way of opening 60 which is connected to seawater duct 64. The duct is open to the sea at the front of the tank at inlet 62 and at the rear of the tank at outlet 66.

FIG. 4 shows another embodiment where the tank is used to store both fuel and weapons. The lower portion of the hull of the tank contains several doors 70 which pivot outwardly into the sea. Each door carries a torpedo 72 which assumes the firing position when the corresponding door is opened. The area 74 around the torpedos is filled with seawater ballast. The area above the torpedos is built like the fuel cells in FIG. 3 with a fuel area and a seawater area separated by a diaphragm. Other weapons, such as missiles could similarly be carried in the tank, either with or without fuel storage.

The operation of the fuel storage system of FIGS. 3 and 4 begins with the upper fuel compartment of each cell 54 being filled and the lower compartment 58 being essentially empty. The diaphragm 56 is depressed to a position near the bottom of the cell. Fuel tank 44 on board is also full at this time. Fuel is first removed from the onboard fuel tank until a certain lower limit is reached. A float switch (not shown) or similar device indicates that fuel should be transferred from the cells 30 and placed in the onboard tank 44. Selector valves 40 may be manually or automatically controlled to allow fuel to flow from the cells to the onboard tank 44. The valves may be controlled to draw equal amounts from each cell so as to cause the buoyancy to be equally distributed, or fuel may selectively be removed to deliberately create a desired imbalance or shift in center of gravity. The fuel may be pumped aboard, but the preferred method is to utilize the ram force of the seawater through the inlet 62 to force the fuel up and on board. As the ship moves forward, seawater is forced into the inlet 62 creating an increase in pressure in the duct 64, due to the speed of the craft, though openings 60 and against the bottom of diaphragm 56. The diaphragm is pushed upwardly, forcing the fuel contained in the upper compartment up through conduit 38 and into the fuel tank 44, by way of valves 40 and conduit 42. This movement is aided by the buoyancy of the fuel compared to seawater. The pressure in the duct 64 is slightly less near the rear end of the tank then it is near the inlet 62. However, any differential in flow from the cells may be controlled by valves 40.

If increased buoyancy is desired, a source of compressed air 52, on board the ship, is connected to the conduits 38 through valve 48, after closing valve 40. The compressed air is forced down into the upper compartment of the cells, displacing the diaphragm downwardly and forcing the seawater in the lower compartment out opening 60 and into duct 64. The replacement of seawater with air greatly increases the buoyancy of the cells. Thus, any desired buoyancy condition may be obtained by displacing the seawater ballast with air.

Various modifications can be made in the fuel storage system, such as the use of pumps to move the fuel rather than the ram system. Separate conduits 38 could be replaced by a common conduit. The void compartments at each end could be filled with a buoyancy or ballast material or be connected to the air system to control the buoyancy effect. The compressed air may be supplied by a compressor system or tank of compressed air. Varying numbers of fuel cells may be provided.

Numerous additional modifications and variations of the present invention are possible in light of the above teachings. It is therefore to be understood that within the scope of the appended claims the invention may be practiced otherwise than as specifically described herein.

What is claimed is:

1. A submerged storage tank for a hydrofoil ship, said storage tank comprising:

an elongated torpedo shaped hull;

a plurality of hull foils permanently connected to said hull and separate from the foils of said ship;

a plurality of struts extending generally upwardly from said hull foils; and at least one attachment means at the upper end of each strut detachably connecting said storage tank to the hull of said ship;

said ship being operable with the attachment of said storage tank using both the ship foils and the hull foils; and with the detachment of said storage tank using the ship foils;

whereby the attachment of said storage tank or lack thereof does not detrimentally affect the operation of said hydrofoil ship.

2. A submerged storage tank according to claim 1, further comprising a steering mechanism attached to the rear end of said tank hull separate from the steering mechanism of the ship.

3. A submerged storage tank according to claim 2, wherein the hull foils include control surfaces.

4. A submerged storage tank according to claim 1, wherein said tank hull contains a plurality of fuel storage cells, each of said cells being divided into an upper and lower compartment by a flexible diaphragm, said upper compartment containing fuel and said lower compartment containing ballast, said upper compartment being connected to said ship by a conduit.

5. A submerged storage tank for a hydrofoil ship, said storage tank comprising:

an elongated torpedo shaped hull containing a plurality of fuel storage cells, each of said cells being divided into an upper and lower compartment by a flexible diaphragm, said upper compartment containing fuel and said lower compartment containing ballast, said upper compartment being connected to said ship by a conduit, said hull further containing a duct in communication with the sea and with said lower compartments, whereby the pressure of seawater in the duct forces said fuel up the conduit and into the ship;

a plurality of foils connected to said hull;

a plurality of struts extending generally upwardly from said foils; and at least one attachment means at the upper end of each strut;

whereby each attachment means is connected to the hull of said hydrofoil ship so as to be easily detached therefrom and whereby the attachment of said storage tank or lack thereof does not detrimentally affect the operation of said hydrofoil ship.

6. A submerged storage tank according to claim 5, said conduit also carries compressed air from said ship into said upper compartment to force ballast out said duct.

* * * * *